United States Patent [19]

Johansson et al.

[11] 4,149,582

[45] Apr. 17, 1979

[54] DUMMY BAR HEAD FOR CONTINUOUS CASTING AND METHOD OF STARTING A CONTINUOUSLY CAST STRAND

[75] Inventors: Nils E. Johansson, Bedford Hills; Carl Langner, Monsey, both of N.Y.

[73] Assignee: Concast Incorporated, Montvale, N.J.

[21] Appl. No.: 819,592

[22] Filed: Jul. 28, 1977

[51] Int. Cl.[2] ..... B22D 11/08

[52] U.S. Cl. ..... 164/82; 164/426

[58] Field of Search ..... 164/425, 426, 82, 445, 164/446

[56] References Cited

U.S. PATENT DOCUMENTS

| | | | |
|---|---|---|---|
| 2,176,990 | 10/1939 | Crampton | 164/425 |
| 3,080,625 | 3/1963 | Pearson et al. | 164/425 |
| 3,795,270 | 3/1974 | Fiala et al. | 164/425 X |
| 4,036,280 | 7/1977 | Rohrig | 164/437 X |

FOREIGN PATENT DOCUMENTS

| | | | |
|---|---|---|---|
| 1959104 | 5/1971 | Fed. Rep. of Germany | 164/425 |
| 39225 | 12/1968 | Japan | 164/426 |
| 725323 | 3/1955 | United Kingdom | 164/426 |

*Primary Examiner*—Richard B. Lazarus
*Assistant Examiner*—John S. Brown
*Attorney, Agent, or Firm*—Tobias Lewenstein

[57] ABSTRACT

A dummy or starter bar for starting a strand in a continuous casting installation having an open-ended mold is provided with a head which is receivable in the mold. The dummy bar head has a peripheral surface which faces the inner surface of the mold. The dummy bar head further has an end face at least part of which is inclined with respect to the peripheral surface. The end face is directed towards the inlet end of the mold. The dummy bar head is provided with a dovetail-like recess which opens to the inclined part of the end face. The recess enables the strand to become coupled to the dummy bar head and is arranged so that coupling occurs in a manner which permits the strand and the dummy bar head to become detached by relative movement thereof in a direction transverse to the longitudinal axis of the strand. The recess is bounded so as to prevent penetration thereof into the peripheral surface of the dummy bar head and this, in conjunction with the inclination provided for the end face of the dummy bar head, enables the dummy bar head to be readily sealed in the mold. A method of starting the strand involves placing bars of chill material in the recess in such a manner that they are inclined with respect to the inner surface of the mold and that the ends thereof are located in the undercut section of the recess. The molten material introduced into the recess solidifies about the chill bars. The latter serve as an anchor within the solidifying mass thus providing an enhanced connection between the dummy bar head and the strand in the first few critical moments of withdrawal of the strand from the mold.

9 Claims, 10 Drawing Figures

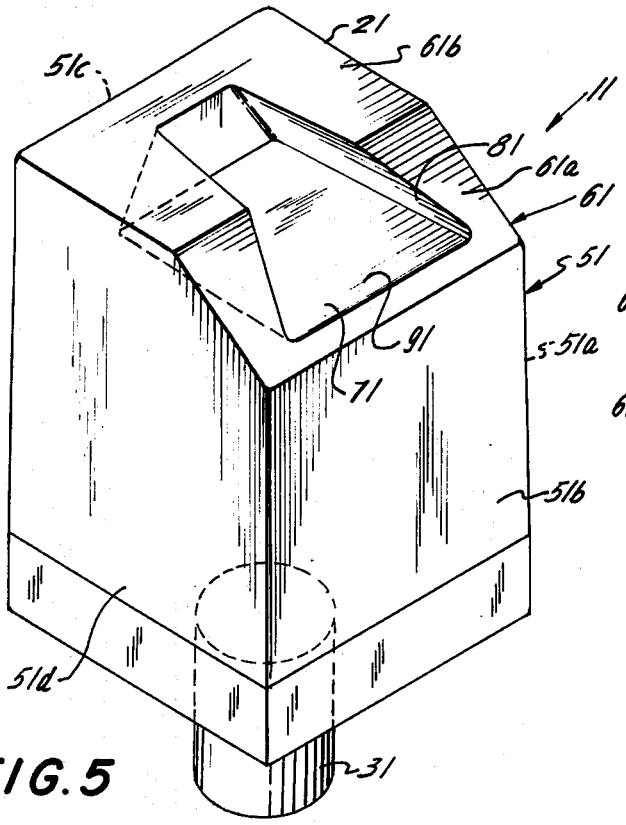
FIG. 5
FIG. 10
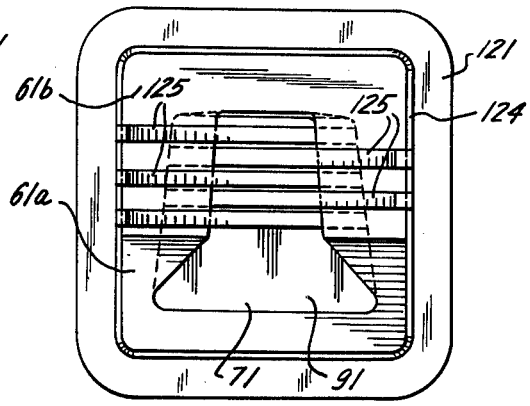
FIG. 9
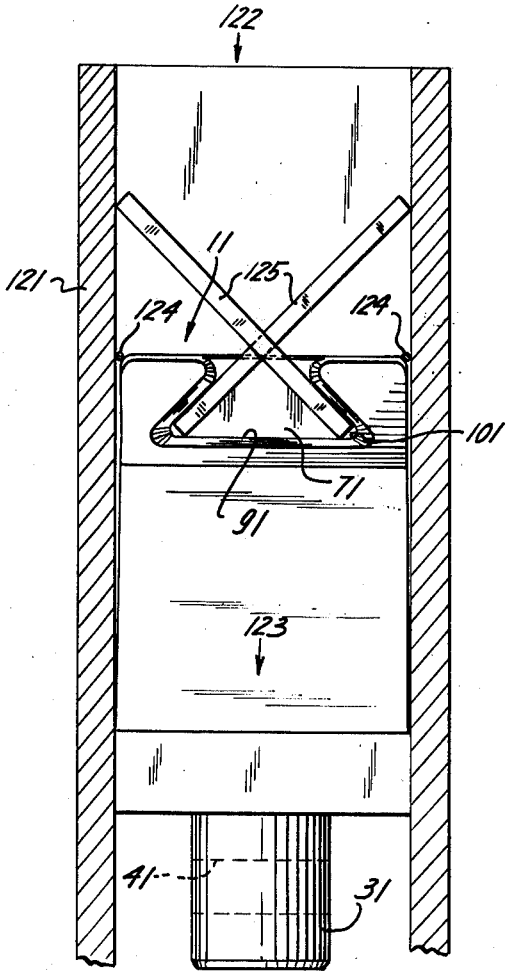
FIG. 7
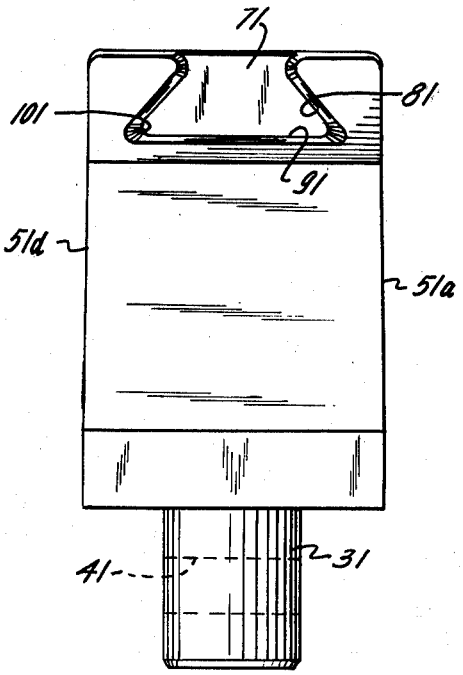

DUMMY BAR HEAD FOR CONTINUOUS CASTING AND METHOD OF STARTING A CONTINUOUSLY CAST STRAND

FIELD OF THE INVENTION

The invention relates generally to continuous casting, especially the continuous casting of metals.

More particularly, the invention relates to a dummy or starter bar for starting a continuously cast strand. The invention also relates to a method of starting the strand.

BACKGROUND OF THE INVENTION

A characteristic of continuous casting installations is a mold having opposite open ends. Molten material is introduced into one of the ends of the mold and partially solidifies therein to form a solidified shell with a molten core. The shell issues from the other end of the mold in the form of a continuous strand.

A strand must be started at the beginning of the casting operation and a dummy or starter bar is used for this purpose. This bar has a head which conforms to the cross-section of the mold cavity and fits therein with close clearance. The dummy bar head is inserted in the mold cavity prior to starting the cast and the spaces between the dummy bar head and the inner walls of the mold are then usually sealed. Thereafter, molten material is admitted into the mold cavity. The first quantities of molten material admitted into the mold cavity solidify in contact with the dummy bar head. Once this has occurred, the dummy bar head is withdrawn from the mold in any suitable manner. The dummy bar head draws the cast strand behind it until the strand can be engaged by the driven rollers of the casting installation. The dummy bar head and the strand are then disconnected. The rate of withdrawal of the dummy bar head from the mold, as well as the rate of withdrawal of the strand by the driven rollers of the casting installation once the strand has been disconnected from the dummy bar head, are so related to the rate of introduction of molten material into the mold that a solidified shell with a molten core always issues from the mold.

The dummy bar head is provided with some form of coupling means so that a connection may be formed between the strand and the dummy bar head.

One known type of dummy bar head has no coupling means of its own. A coupling element, e.g., a bolt, is secured to the dummy bar head before the start of a cast. This coupling element is disconnected from the dummy bar head after the strand has been started. It is generally intimately connected with the leading crop end of the strand and is discarded therewith. As a result, it becomes relatively expensive to operate with this type of dummy bar head when large numbers of multiple strand casts must be started.

This problem is alleviated by using a dummy bar head having coupling means permanently associated therewith. The present invention is mainly concerned with a dummy bar head of this type and with a method of connecting such a dummy bar head with the cast strand.

A known dummy bar head with permanent coupling means is provided with a notch which forms a hooklike cavity in conjunction with the adjacent wall of the mold. Molten metal flows into the hooklike cavity. Upon solidification of the molten metal, a connection in the form of interlocking hooks is formed between the dummy bar head and the solidified molten metal. The connection may be broken by moving the dummy bar head sideways relative to the strand. This dummy bar head works well for the casting of slabs where the latter are guided and supported by closely spaced pairs of rollers between the mold and the location where the dummy bar head is disconnected from the strand. In this case, the close confinement of the dummy bar head and the strand prevents premature disconnection thereof. However, where the dummy bar head and the strand are not closely confined, as is usually the case in the casting of strands such as blooms and billets which are of smaller cross-section, the dummy bar head tends to disconnect from the strand prematurely. This is particularly true where the dummy bar head and the strand move along a curved path. Other disadvantages associated with this dummy bar head are as follows: it is difficult to seal in the mold since certain of the edges which must be sealed are not readily accessible; and it is difficult to machine and recondition due to the configuration of the notch provided therein.

In a modified form of the above dummy bar head, the notch is undercut. Although this alleviates the tendency of the dummy bar head to disconnect from the strand prematurely, the undercut configuration gives rise to another difficulty. Thus, the dummy bar head does not disconnect from the strand in a smooth and trouble-free manner.

A dummy bar head bearing a similarity to that discussed above also forms a connection with the strand via interlocking portions on the strand and the dummy bar head. Here, the configuration is such that, as opposed to the previously-described dummy bar head, the connection between the strand and the dummy bar head is broken by rotating the latter relative to the strand. This dummy bar head suffers the same disadvantages as the one discussed above.

Other dummy bar heads having permanent coupling means are known. However, all of these exhibit the common disadvantage of being difficult to seal in the mold.

OBJECTS OF THE INVENTION

It is an object of the invention to provide a dummy bar head which may be readily sealed in the mold.

Another object of the invention is to provide a dummy bar head which remains firmly but releasably coupled to the strand even when the latter moves in a curved path in the absence of a guide.

An additional object of the invention is to provide a dummy bar head which is reusable and which is provided with permanent coupling means for connection thereof with the strand.

It is also an object of the invention to provide a dummy bar head which may be readily disconnected from the strand when desired.

Still another object of the invention is to provide a dummy bar head which is simple to machine and recondition.

A concomitant object of the invention is to provide a method of releasably but securely connecting a dummy bar head with a strand.

SUMMARY OF THE INVENTION

One aspect of the invention relates to a dummy bar for starting a strand in a continuous casting installation having an open-ended mold. The dummy bar includes a dummy bar head which is receivable in the mold cavity prior to initiating casting of the strand. The dummy bar head has a peripheral surface which confronts the inner surface of the mold when the dummy bar head is in the mold cavity. The dummy bar head also has an end face which faces the inlet end of the mold when the dummy bar head is in the mold cavity. At least part of the end face is inclined with respect to the peripheral surface of the dummy bar head. The dummy bar head is provided with a dovetail-like recess arranged to obtain coupling of the strand and the dummy bar head in such a manner that the strand and the dummy bar head are detachable by relative movement thereof in a direction transverse to the longitudinal axis of the strand. The recess is open to the inclined part of the end face of the dummy bar head and is bounded so as to prevent penetration thereof into the peripheral surface of the dummy bar head.

As a result of the dovetail-like recess provided in the dummy bar head of the invention, a firm yet releasable connection is obtainable between the dummy bar head and the strand even when the latter moved along a curved path in the absence of guide elements. Although the connection between the dummy bar head and the strand may be made firm enough to resist disconnection during movement along a curved path, the configuration of the recess nevertheless permits the dummy bar head and the strand to be readily uncoupled from one another when this is desired. Since the dovetail-like recess constitutes a permanent coupling means, a savings in coupling material may be realized. The dovetail-like recess of the invention also provides the advantage of being relatively easy to manufacture.

Due to the inclination in the end face of the dummy bar head and the fact that the recess is prevented from penetrating the peripheral surface of the dummy bar head, the latter may be sealed in the mold with relatively great ease. The relatively simple sealing which becomes available according to the invention makes it possible to re-start casting of a strand in a multistrand installation when casting has been interrupted. Another advantage, which results in part from the inclination provided in the end face of the dummy bar head, resides in that it now becomes possible for the latter to fulfill its function without too great a penetration thereof into the mold. This is particularly true when only part of the end face is inclined and the remainder thereof is substantially normal to the peripheral surface of the dummy bar head.

Another aspect of the invention is found in a method of casting a strand in a continuous casting installation having an open-ended mold. The method utilizes a dummy bar head provided with a recess having an undercut section. The dummy bar head is inserted in the mold cavity so that the opening of the recess faces the inlet end of the mold cavity. Chill material is placed in the recess. The chill material includes an elongated member, e.g., a rod, which is positioned with an inclination to the bounding surface or wall of the mold cavity. An end of the elongated member is placed in the undercut section. Molten material is admitted into the recess. The molten material solidifies about the elongated member so that a connection is formed between the elongated member and the solidified molten material. The dummy bar head is withdrawn from the mold cavity to start the strand.

In the method of the invention, the elongated member is positioned so that an end thereof is locked by the undercut section of the recess when the dummy bar head is withdrawn from the mold. This provides an additional anchoring effect for the strand during the first critical moments immediately following the onset of movement of the dummy bar head.

BRIEF DESCRIPTION OF THE DRAWINGS

Other features of the invention will become apparent from the accompanying drawings wherein:

FIG. 5 is a perspective view of another embodiment of a dummy bar head according to the invention;

FIG. 7 is an end view of the dummy bar head of FIG. 5;

FIGS. 9 and 10 show the dummy bar head of FIG. 5 in a mold in order to illustrate the method of the invention.

DESCRIPTION OF THE PREFERRED EMBODIMENTS

Figure 1:
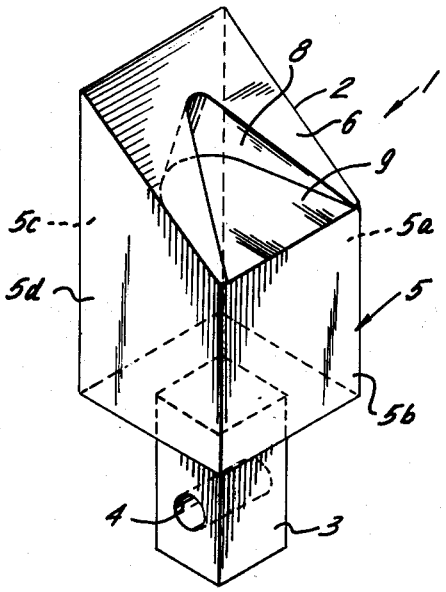
FIG. 1 is a perspective view of one embodiment of a dummy bar head according to the invention.
Figure 4:
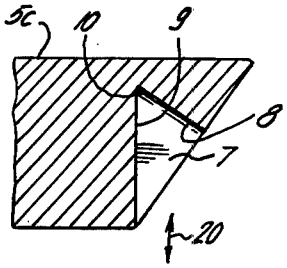
FIG. 4 is a view in the direction of the arrows IV—IV of FIG. 2.
Figure 3:
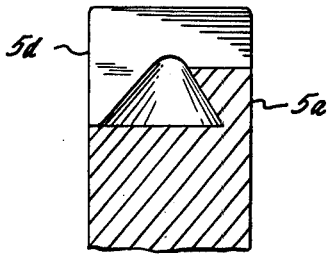
FIG. 3 is a view in the direction of the arrows III—III of FIG. 2.
Figure 2:
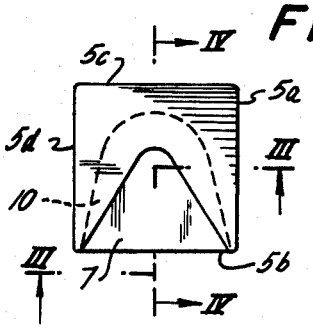
FIG. 2 is a plan view of the dummy bar head of FIG. 1.

FIGS. 1–4 illustrate one embodiment of a dummy bar head according to the invention, the dummy bar head being identified generally by the reference numberal 1. The dummy bar head 1 includes a coupling section 2 for effecting a connection with a strand being cast. The dummy bar head 1 further includes a connecting section 3 via which the dummy bar head 1 may be connected with the non-illustrated main portion of the dummy bar. Although the dummy bar head 1 may be connected with the main portion of the dummy bar in any convenient manner, the connecting section 3 is here shown as being provided with an opening 4 for a pin which passes through a corresponding opening in the main portion of the dummy bar.

The coupling section 2 has a peripheral surface 5 constituted by the surface portions 5*a*, 5*b*, 5*c*, and 5*d*. The peripheral surface 5 confronts the inner surface of the mold, that is, the wall bounding the mold cavity, when the dummy bar head 1 is in operative position in the mold.

The coupling section 2 further has an end face 6 which is inclined with respect to the peripheral surface 5. A recess 7 is provided in the coupling section 2 and has an opening in the end face 6. The recess 7 is bounded by an arcuate circumferential wall 8 and a substantially planar wall 9.

The recess 7 has an undercut section 10, that is, the recess 7 is of dovetail-like configuration. The dummy bar head 1 is placed in the mold with the end face 6 facing the inlet end of the mold. The first quantities of molten material, e.g., steel, introduced into the mold can thus flow into the undercut section 10. Upon solidification of this molten material, a connection is formed between the dummy bar head 1 and the strand being cast.

The recess 7 increases in depth in a direction from the intersection of the end face 6 with the peripheral surface 5*b* to the intersection of the end face 6 with the peripheral surface portion 5*c*. The recess 7 also narrows in this direction. This configuration of the recess 7, in conjunction with the undercut section 10 thereof, has the result that the connection between the dummy bar head 1 and the strand being cast is such that the latter and the dummy bar head 1 can be disengaged only by relative movement thereof in a direction normal, or at least approximately normal, to the longitudinal axis of the strand. The direction of relative movement of the dummy bar head 1 and the strand in order to effect disengagement thereof is indicated by the double-headed arrow 20.

The recess 7 constitutes a permanent coupling means enabling the dummy bar head 1 to be coupled with a strand being cast.

Although the recess 7 is shown as terminating at the intersection of the end face 6 with the peripheral surface portion 5*b*, it is possible for the recess 7 to terminate short of this intersection.

The recess 7 does not penetrate the peripheral surface 5 of the dummy bar head 1, that is, the recess 7 does not have an opening in the peripheral surface 5. Accordingly, when the dummy bar head 1 is in operative position in the mold, the recess 7 has no edges beyond the end face 6 as seen from the inlet end of the mold. This contributes to ease of sealing of the dummy bar head 1 in the mold. It may be pointed out that, if the recess 7 had an opening in the peripheral surface 5, there would be corresponding edges beyond the end face 6 which require sealing. Access to such edges would be difficult due to their location behind the end face 6.

The recess 7 is preferably so positioned that the longitudinal center line of the mold passes through the opening provided in the end face 6 when the dummy bar head 1 is in operative position in the mold.

Figure 8:
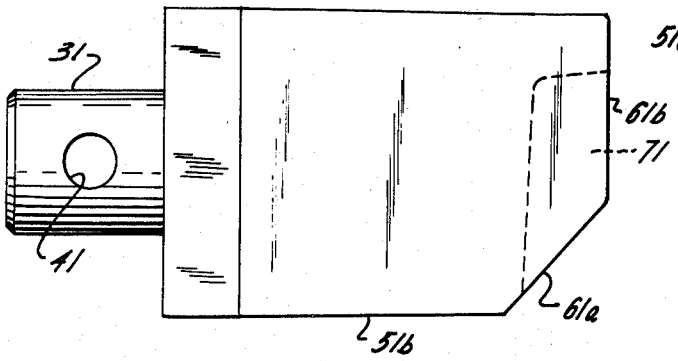
FIG. 8 is a side view of the dummy bar head of FIG. 5.
Figure 6:
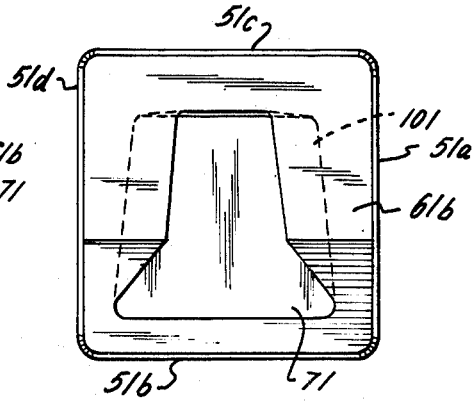
FIG. 6 is a plan view of the dummy bar head of FIG. 5.

FIGS. 4–8 illustrate another embodiment of a dummy bar head according to the invention. In FIGS. 4–8, the same reference numerals as in the preceding FIGURES, but with the suffix 1, have been used to identify similar elements.

The dummy bar head 11 of FIGS. 4–8 has a coupling section 21 for effecting a connection with the strand being cast. The dummy bar head 11 also has a connecting section 31 for connecting it with the main portion of the dummy bar. The connecting section 31 is provided with an opening 41 for a pin which passes through a corresponding opening in the main portion of the dummy bar.

The coupling section 21 has a peripheral surface 51 constituted by the surface portions 51*a*, 51*b*, 51*c*, and 51*d*. The peripheral surface 51 confronts the inner surface of the mold when the dummy bar head 11 is in operative position in the mold.

The coupling section 21 further has an end face 61 which faces the inlet end of the mold when the dummy bar head 11 is in operative position in the mold. The end face 61 includes a portion 61*a* which is inclined with respect to the peripheral surface 51. The end face 61 additionally includes a portion 61*b* which, in the illustrated embodiment, is normal, or at least approximately normal, to the peripheral surface 51. In general, the portion 61*b* of the end face 61 is oriented so as to be perpendicular, or at least approximately so, to the longitudinal axis of the mold when the dummy bar head 11 is in operative position in the mold. This configuration is particularly well-suited to minimize the amount of space which must be occupied by the dummy bar head in the mold.

A recess 71 is provided in the coupling section 21 and has openings in both the portion 61*a* and the portion 61*b* of the end face 61. The recess 71 is bounded by a circumferential wall 81 and a substantially planar wall 91.

The recess 71 has an undercut section 101, i.e., the recess 71 is of dovetail-like configuration. As already mentioned, the dummy bar head 11 is placed in the mold with the end face 61 facing the inlet end of the mold. This enables the first quantities of molten material admitted into the mold to flow into the undercut section 101 and solidify therein to thereby establish a connection between the dummy bar head 11 and the strand being cast.

The recess 71 increases in depth in direction from the intersection of the end face 61 with the peripheral surface portion 51*b* to the intersection of the portions 61*a* and 61*b* of the end face 61. The recess 71 also narrows in this direction. From the intersection of the portions 61*a* and 61*b* of the end face 61 towards the peripheral surface portion 51*c*, the recess 71 is of substantially constant depth. The constant-depth portion of the recess 71 may have a substantially constant width but preferably narrows slightly in a direction away from the junction of the portions 61*a* and 61*b* of the end face 61. This configuration of the recess 71, in conjunction with the undercut section 101 thereof, has the result that the connection between the dummy bar head 11 and the strand being cast is such that the latter and the dummy bar head 11 can be disengaged only by relative movement thereof in a direction normal, or at least approximately normal, to the longitudinal axis of the strand. The direction of relative movement of the dummy bar head 11 and the strand in order to effect disengagement thereof is indicated by the double-headed arrow 201.

Although the recess 71 is shown as terminating short of the intersection between the portion 61*a* of the end face 61 and the peripheral surface portion 51*b*, it is possible for the recess 71 to terminate at this intersection.

The recess 71 does not penetrate the peripheral surface 51 of the dummy bar head 11, that is, the recess 71 does not have an opening in the peripheral surface 51. As explained earlier, this contributes to ease of sealing of the dummy bar head 11 in the mold inasmuch the recess 71 thus provides no edges to which access is difficult.

The recess 71 is preferably so positioned that the longitudinal center line of the mold passes through the opening provided in the portion 61*b* of the end face 61 when the dummy bar head 11 is in operative position in the mold.

In order to facilitate disconnection of the dummy bar head 11 from the strand being cast when this is desired, the peripheral surface portions 51*a*, 51*b*, 51*c*, and 51*d*, as well as the portion 61*b* of the end face 61, are preferably provided with an inward taper. These tapers need not be large and may, for example, be of the order of 1 or 2°.

The dummy bar head of the invention is particularly well-suited for use in billet and bloom machines. In addition to the square and rectangular cross-sections normally cast in such machines, the dummy bar head of the invention may be used for the casting of other polygonal cross-sections as well as for the casting of rounds. It is simply necessary to insure that the cross-sectional configuration of the dummy bar head conforms to that of the mold cavity and that the dummy bar head fits in the mold cavity relatively snugly. The dummy bar head of the invention may be made of any material which is capable of carrying a load and which will not melt under the existing casting conditions. For instance, a dummy bar head for use in the casting of steel may be made of steel.

Due to the undercut section provided therein, the dummy bar head of the invention remains firmly secured to the strand being cast even when the latter moves in a curved path in the absence of guiding means. Nevertheless, the configuration of the recess provided in the dummy bar head of the invention permits the latter to be disconnected from the strand whenever desired simply by moving the dummy bar head and the strand relative to one another in a direction transverse to the longitudinal axis of the strand. The dummy bar head of the invention is also relatively simple to machine inasmuch as the recess provided for the purpose of coupling the dummy bar head with the strand has a relatively simple configuration.

FIGS. 9 and 10 illustrate a method which may be used to obtain enhanced coupling between a dummy bar head and a strand being cast. An enhanced coupling between the dummy bar head and the strand is particularly desirable at the moment that the dummy bar head begins to move and in the first critical moments following the onset of motion of the dummy bar head. It is during this period, when a steady-state condition has not yet been established, that the strand is likely to break away from the dummy bar head.

In FIGS. 9 and 10, the dummy bar head 11 of FIGS. 4–8 is shown in operative position in a mold 121 prior to initiation of a cast. The dummy bar head 11 may be inserted in the mold 121 in any conventional manner and is assumed to be connected with the main portion of a dummy bar which has been omitted here for the sake of clarity. The mold 121 may be an open-ended mold of any conventional design and is here assumed to belong to a continuous casting installation of the vertical, straight-mold type or the curved-mold type such as are used for the casting of metals, e.g. steel. The inlet end of the mold 121, via which molten material is admitted into the mold 121, is indicated by the arrow 122 whereas the outlet end of the mold 121, via which the cast strand issues from the mold 121, is indicated by the arrow 123.

In order to prevent penetration of molten material between the outer surface of the dummy bar head 11 and the inner surface of the mold 121, the dummy bar head 11 is sealed in the mold 121 in conventional manner. Heat-resistant material 124 may be placed inside the mold 121 so as to cover any gaps existing between the outer surface of the dummy bar head 11 and the inner surface of the mold 121.

In practice, it is conventional to place chill material such as scrap on a dummy bar head in order to accelerate solidification of the first quantities of molten material introduced into the mold. The purpose is to rapidly form a firm connection between the dummy bar head and the strand being cast so that withdrawal of the dummy bar head from the mold may be begun without undue delay.

In accordance with the invention, it is proposed that at least a portion of the chill material be in the form of rods 125 each of which is positioned with an end thereof projecting into the undercut section 101 of the dummy bar head 11. The bars 125 are inclined with respect to the inner surface of the mold 121. Preferably, the bars 125 contact this inner surface in order to become rapidly encased in the solidifying shell. It is preferred for adjacent rods 125 to be inclined in opposite directions as shown since a more uniform force distribution will be obtained in this manner. It is further preferred for the rods 125 to be positioned in the constant-depth portion of the recess 71 as shown, that is, for the rods 125 to pass through the opening provided in the portion **61*b* of the end face 61**.

Once the dummy bar head 11 has been sealed in the mold 121 and the chill rods 125, as well as any other chill materials which may be desired, have been placed on the dummy bar head 11, molten material is admitted into the mold 121 via the inlet opening 122. The introduction of molten material into the mold 121 may be accomplished in conventional manner. The molten material is generally admitted into the mold 121 in the form of a stream which, at least approximately, travels along the longitudinal axis of the mold 121. As mentioned previously, it is preferable for the recess 71 to be formed such that the longitudinal axis of the mold 121 passes through the opening provided in the portion **61*b* of the end face 61 when the dummy bar head 11 is in operative position in the mold 121. When the latter condition is met and the stream of molten material enters the mold 121 along the longitudinal axis thereof, the rods 125 serve as a shield protecting the wall 91 of the dummy bar head 11 from direct impingement by the stream of molten material. This will serve to inhibit erosion of the dummy bar head 11** and thereby extend its life.

The first quantities of molten material admitted into the mold 121 enter the undercut section 101 of the dummy bar head 11 and flow about the ends of the rods 125 which project into the undercut section 101. The molten material solidifies in the undercut section 101 and about the ends of the rods 125 so that a connection is formed between the solidified molten material, the rods 125 and the dummy bar head 11.

When solidification has proceeded to a sufficient extent, withdrawal of the dummy bar head 11 from the mold 121 is initiated. This may be accomplished in a conventional manner. The dummy bar head 11 leaves the mold 121 via the outlet opening 123 drawing the cast strand behind it. When the dummy bar head 11 has advanced the cast strand sufficiently so that the latter may be engaged by the driven rollers of the continuous casting installation thereby making continued use of the dummy bar head 11 unnecessary, the dummy bar head 11 is disconnected from the cast strand. This may be effected in any convenient manner by causing the dummy bar head 11 to move relative to the cast strand in a direction transverse to the longitudinal axis of the latter. The dummy bar head 11 and the remainder of the dummy bar may then be stored in a conventional manner to await the start of a new cast.

During the period that the dummy bar head 11 draws the cast strand behind it, the rods 125 serve to provide an enhanced coupling effect between the dummy bar head 11 and the cast strand. This is particularly true at the time that the motion of the dummy bar head 11 is initiated and during the period immediately following the onset of motion of the dummy bar head 11. The rods 125 serve as anchors in that the upper ends thereof are firmly encased in the solidified mass formed adjacent to the wall of the mold 121 while the lower ends thereof, which project into the undercut section 101 of the dummy bar head 11, tend to bear against the portion of the dummy bar head 11 overlying the undercut section 101.

It will be understood that various modifications can be made within the scope of the invention.

I claim:

1. A dummy bar for starting a strand in a continuous casting installation having an open-ended mold, said dummy bar comprising:

a dummy bar head receivable in the mold cavity prior to initiating casting of the strand, said dummy bar head having a peripheral surface which confronts the inner surface of the mold when said dummy bar head is in the mold cavity, and said dummy bar head having an end face at least part of which is inclined with respect to said peripheral surface and which faces the inlet end of the mold when said dummy bar head is in the mold cavity, said dummy bar head being provided with a dovetail-like recess arranged to obtain coupling of the strand and said dummy bar head in such a manner that the strand and said dummy bar head are detachable by relative movement thereof in a direction transverse to the longitudinal axis of the strand, and said recess being open to said part of said face and having no opening in said peripheral surface, the inclination of said part of said face combined with the absence of an opening for said recess in said peripheral surface permitting ready sealing of said dummy bar head in the mold cavity.

2. A dummy bar as defined in claim 1, wherein said end face is inclined with respect to said peripheral surface substantially in its entirety.

3. A dummy bar as defined in claim 2, wherein the opening of said recess is arranged so that the center line of the mold cavity passes therethrough when said dummy bar head is in the mold cavity.

4. A dummy bar as defined in claim 1, wherein said recess is arranged so that the strand and said dummy bar head are detachable by relative movement thereof in a direction substantially normal to the axis of the strand.

5. A method of casting a strand in a continuous casting installation having an open-ended mold, said method comprising the steps of:

(a) inserting a dummy bar head into the mold cavity, said dummy bar head being provided with a recess having an undercut section, and said dummy bar head being inserted into said mold cavity so that an opening of said recess faces the inlet end of said mold cavity;

(b) placing chill material in said recess, said chill material including a rod-like member which is positioned with an inclination to the bounding surface of said mold cavity and so that one end thereof is in said undercut section while the other end thereof projects above said dummy bar head;

(c) admitting molten material into said recess, said molten material solidifying about said rod-like member so that a connection is formed between said rod-like member and the solidified molten material; and (d) withdrawing said dummy bar head from said mold cavity to start said strand, said rod-like member serving as an anchor to provide a secure connection between said dummy bar head and said strand in the early stages of withdrawal due to the positioning of said rod-like member in said recess whereby the tendency of said rod-like member to be withdrawn from said recess is counteracted by the bearing of said one end of said rod-like member against said undercut section of said recess.

6. A method as defined in claim 5, wherein said rod-like member is positioned in the path of said molten material so as to at least partially dissipate the energy of said molten material prior to impaction thereof on said dummy bar head to thereby inhibit erosion of said dummy bar head by said molten material.

7. A method as defined in claim 5, wherein said other end of said rod-like member is positioned in the region of said bounding surface.

8. A dummy bar for starting a strand in a continuous casting installation having an open-ended mold, said dummy bar comprising:

a dummy bar head receivable in the mold cavity prior to initiating casting of the strand, said dummy bar head having a peripheral surface which confronts the inner surface of the mold when said dummy bar head is in the mold cavity, and said dummy bar head having an end face which includes two parts, one of said parts being inclined with respect to said peripheral surface and facing the inlet end of the mold when said dummy bar head is in the mold cavity, and the other of said parts intersecting said one part of said end face and being substantially normal to said peripheral surface, said dummy bar head being provided with a dovetail-like recess arranged to obtain coupling of the strand and said dummy bar head in such a manner that the strand and said dummy bar head are detachable by relative movement thereof in a direction transverse to the longitudinal axis of the strand, and said recess being open to each of said parts of said end face and having no opening in said peripheral surface, the inclination of said one part of said end face combined with the absence of an opening for said recess in said peripheral surface permitting ready sealing of said dummy bar head in the mold cavity.

9. A dummy bar as defined in claim 8, wherein the opening of said recess in said other part of said end face is arranged so that the center line of the mold cavity passes therethrough when said dummy bar head is in the mold cavity.

* * * * *